US006520097B2

(12) United States Patent
Shiveley

(10) Patent No.: US 6,520,097 B2
(45) Date of Patent: Feb. 18, 2003

(54) METHOD OF AN APPARATUS FOR RAPID IN-LINE INCINERATING OF CONTAMINANT COATED HANGERS AND/OR PARTS USING HIGH ENERGY SOURCES

(76) Inventor: James Thomas Shiveley, P.O. Box 41205, Cleveland, OH (US) 44141

( * ) Notice: Subject to any disclaimer, the term of this patent is extended or adjusted under 35 U.S.C. 154(b) by 0 days.

(21) Appl. No.: 09/843,967

(22) Filed: Apr. 27, 2001

(65) Prior Publication Data

US 2001/0035116 A1 Nov. 1, 2001

Related U.S. Application Data

(60) Provisional application No. 60/201,120, filed on May 2, 2000.

(51) Int. Cl.[7] ..... F23G 5/00
(52) U.S. Cl. ..... 110/236; 110/250
(58) Field of Search ..... 432/2, 175; 110/236, 110/255, 257, 250, 346, 171; 134/19, 38

(56) References Cited

U.S. PATENT DOCUMENTS 1,416,865 A * 5/1922 Patch ..... 134/2
2,118,480 A * 5/1938 Somes ..... 110/236
3,909,289 A * 9/1975 Foucart et al. ..... 134/2
3,923,653 A * 12/1975 Lavins ..... 210/71
4,069,790 A * 1/1978 Witte ..... 118/70
4,137,344 A * 1/1979 Lasne et al. ..... 427/156
4,667,609 A * 5/1987 Hardison et al. ..... 110/236
4,668,358 A * 5/1987 Ball ..... 204/150.2
5,024,597 A * 6/1991 Skolnik et al. ..... 432/2
5,026,431 A * 6/1991 Skolnik et al. ..... 134/3
5,034,067 A * 7/1991 Gewirz et al. ..... 134/41
5,133,161 A * 7/1992 Reas ..... 51/417
5,351,632 A * 10/1994 Mann ..... 110/190
5,617,800 A * 4/1997 Moreschi et al. ..... 110/236
5,944,034 A * 8/1999 McRae et al. ..... 134/25.4
6,135,765 A * 10/2000 Jamaluddin ..... 432/75
6,227,847 B1 * 5/2001 Gillispie ..... 432/72

* cited by examiner

*Primary Examiner*—Ira S. Lazarus
*Assistant Examiner*—K. B. Rinehart
(74) *Attorney, Agent, or Firm*—Emerson & Skeriotis; Roger D. Emerson; John M. Skeriotis

(57) ABSTRACT

Method and Apparatus for high intensity infrared burn-off of contaminants on articles moving continuously through an in-line production process.

9 Claims, 2 Drawing Sheets

METHOD OF AN APPARATUS FOR RAPID IN-LINE INCINERATING OF CONTAMINANT COATED HANGERS AND/OR PARTS USING HIGH ENERGY SOURCES

This is a continuation-in-part of provisional application Ser. No. 60/201,120 filed May 2, 2000 to which benefit of its filing date is hereby claimed under 35 U.S.C. § 120, and which is hereby incorporated by reference in its entity herein.

BACKGROUND OF THE INVENTION

Conventional burn-off ovens of the batch type are used to incinerate contaminant or undesired coatings. Typically these burn-off ovens treat hangers or part support structures for carrying parts to be coated via a wet or dry coating system which system has conveyance means such as a monorail, chain on edge, belt driven or other transfer mechanism. Also production painted parts and/or parts to be stripped for recoating after normal service are typically treated in such type burn-off ovens. The rejected parts can arise from use of hangers or support structures for the parts being treated which have gone through the coating process numerous times placing them in condition where the build up coating can begin to flake off and contaminant the production parts. It becomes necessary to monitor hanger use cycle times in order to ensure that they are thermally processed in a burn-off oven such flaking of the coating can take place.

Typical process hardware and a process method may involve continuous in line hangers or part support structures carrying work pieces through a coating spraying system for coating the work pieces, resulting in the hangers and part support structures likewise being at a minimum partially coated. This requires the hangers to be removed from the production line and to be moved in a cart to the batch type burn-off oven. The burn-off oven heats the contents of the cart to a temperature capable of incinerating the coatings on the hangers or other coated parts, over a period of 3 to 12 hours.

In some cases, some ash or residue remains on the processed parts and it may be removed physically such as by a brushing or washing process. The cleaned hanger or support part can then be placed back in service for the next process cycle. In order for the contaminant or undesirous coating to be incinerated in the burn-off ovens they must attain very high temperatures (depending on the thickness of coating materials). Therefore, extensive time is required for the thermal energy to be transferred from the energy source to the contaminated parts. Typically this energy is transferred using convection heating methods due to the number of parts being treated at one time masking them from the use of radiant, impingment or like type alternate heating methods.

FIELD OF THE INVENTION

This invention pertains to the art of methods and apparatuses for cleaning contaminants from articles, and more specifically to methods and apparatuses for incinerating the contaminants.

SUMMARY OF THE INVENTION

The present invention incorporates the utilization of high watt density electric infrared heaters and other high energy heating methods appropriately designed and arranged to incinerated accumulated coatings on work piece carrier hangers and/or coatings from work pieces for refinishing while they are carried through a burn-off oven which is located in-line with the normal in-line coating process line.

Typically exposure time in the burn-off oven is in the order of one minute. It is not necessary to remove the work piece support carriers or work pieces from the conveyor line to accomplish the desired stripping function in a remote high energy batch heating system.

In some cases the ash resulting from the process is so minimal that a cleaning process is not required.

The electric infrared heaters are specifically designed by utilizing high temperature emitters to create rapid heating rates and incorporate high temperature reflective refractories with critical air cooling provisions for improved heater lamp life and heater longevity. Preferably the high energy heating section is completely enclosed to shield operational personnel and to retain any affluent gases created in the burn-off process.

After the burn-off process the work piece support hangers and/or work pieces to be stripped may pass through a cleaning station for removal of ash residue. The cleaned hardware then continues through the production cycle.

The system is designed for continuous in-line operation and may be utilized during all in-line processing; however, the burn-off oven may be deactivated and programmed for specific utilization time where intermittent usage is adequate. Further, the user may choose to utilize the burn-off oven on a side track in an off-line arrangement from the in-line production arrangement; however, utilizing the advantage of not having to remove the work piece carrier supports.

Where necessary burn-off oven installations incorporate affluent gas removal hardware for transferring such gases to a gas burning incinerator which incinerator is known in the prior art.

The system includes necessary control equipment such as a switch gear, temperature controllers, logistic controllers, safety devices, limiting devices and alarming devices as necessary for system control.

In one aspect the invention is a method of rapid incineration of contaminants on articles in a continuous moving environment without removal of the articles from the conveyance means and includes the following steps. Passing the articles in situ of the conveyance means past a high intensity energy source thereby elevating the temperature of the contaminant on the article to the incineration point. Supplying energy to the high energy source in proportion to the speed of the moving articles whereby the time of the articles within the high energy source equals the time necessary to bring the contaminant to the incineration point.

The invention is also a method of rapid heating continuous moving in-line system articles using a high intensity energy source to enable the articles to be cleaned by rapid incineration of contaminants on the articles without removal of the articles from the in-line system conveyance means thereby saving time required from removal and reinstallation of articles as well as shortening heating time.

The invention also anticipates an apparatus for enclosing a continuous in-line system article high energy incineration station including;

a. a container capable of sustaining a negative pressure;

b. an exhaust system;

c. a low pressure inlet/outlet seal; and d. an inner face to a gas incinerator burn-off.

The present invention has the advantage over the prior art batch burn-off systems of faster heating to reduce cleaning time in a production environment. More production time is saved because hangers do not have to be removed from the line. The same is true for support structures. Additional time is saved because the hangers and structures do not have to be reinstalled. A further advantage is there is no need to monitor when cleaning is required such as counting the number of coatings on the hangers. Still another advantage is fewer hangers are needed since a batch type oven may be processing hangers while the coating line is in operation. As a result the invention prevents contamination of treated parts by flaking off of contaminant from hangers over due for cleaning, and fewer hangers are needed by the system of the present invention since those in a batch type oven cannot be used in production whereas the same situation does not occur with the in-line system of the present invention.

The present invention enhances efficiency by cleaning hangers every time it is used, if desired, requiring less energy and possibly eliminating the need for physical removal of residue. Further advantages of the present invention will be apparent upon review of the following detailed description.

BRIEF DESCRIPTION OF THE DRAWING

The invention may take physical form in certain parts and arrangement of parts, a preferred embodiment of which will be described in detail in this specification and illustrated in the accompanying drawings which form a part hereof and wherein.

DETAILED DESCRIPTION OF THE INVENTION

Figure 1:
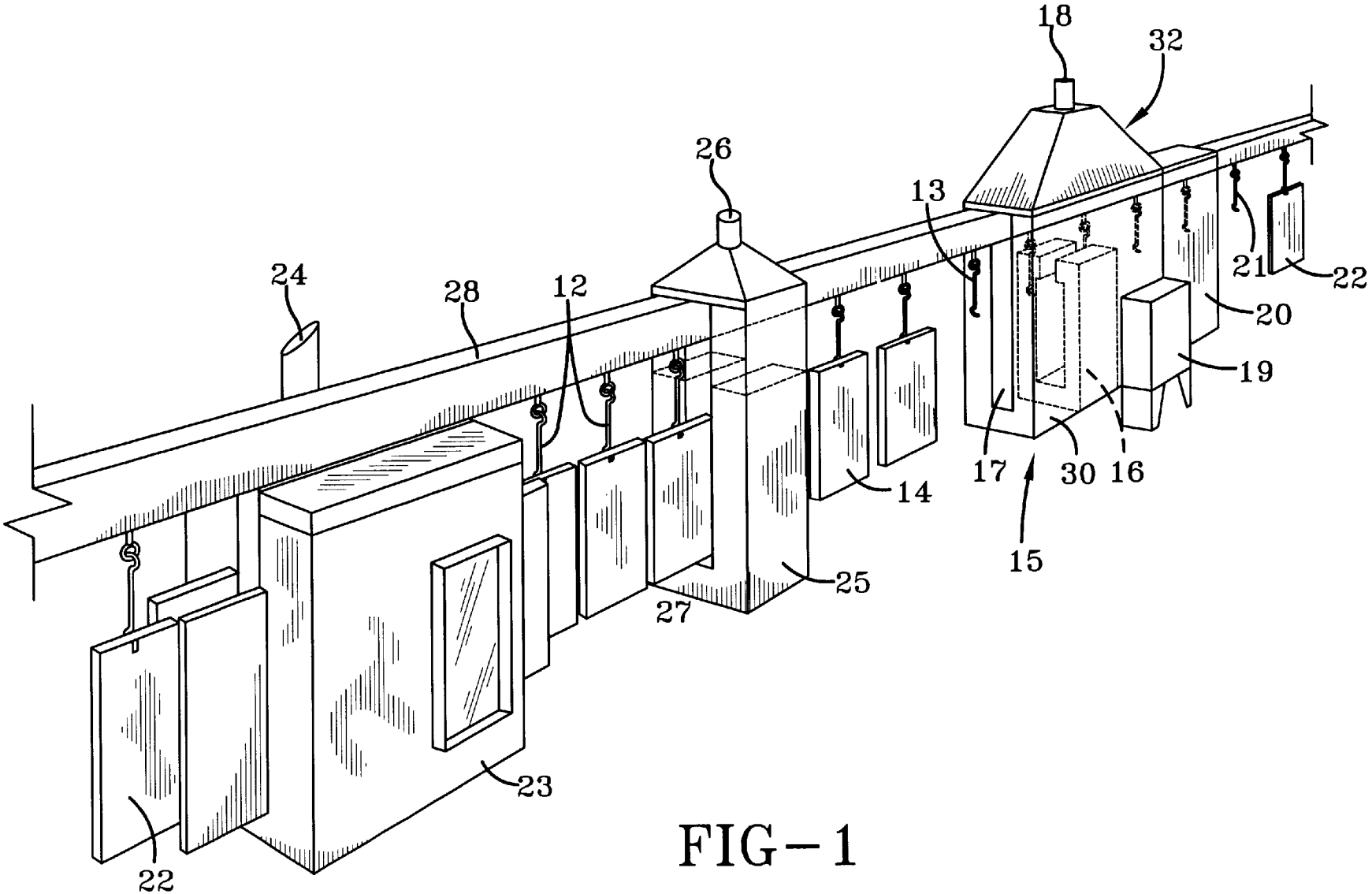
FIG. 1 is a schematic view of an in-line production facility incorporating an in-line burn-off oven of the present invention.
Figure 2:
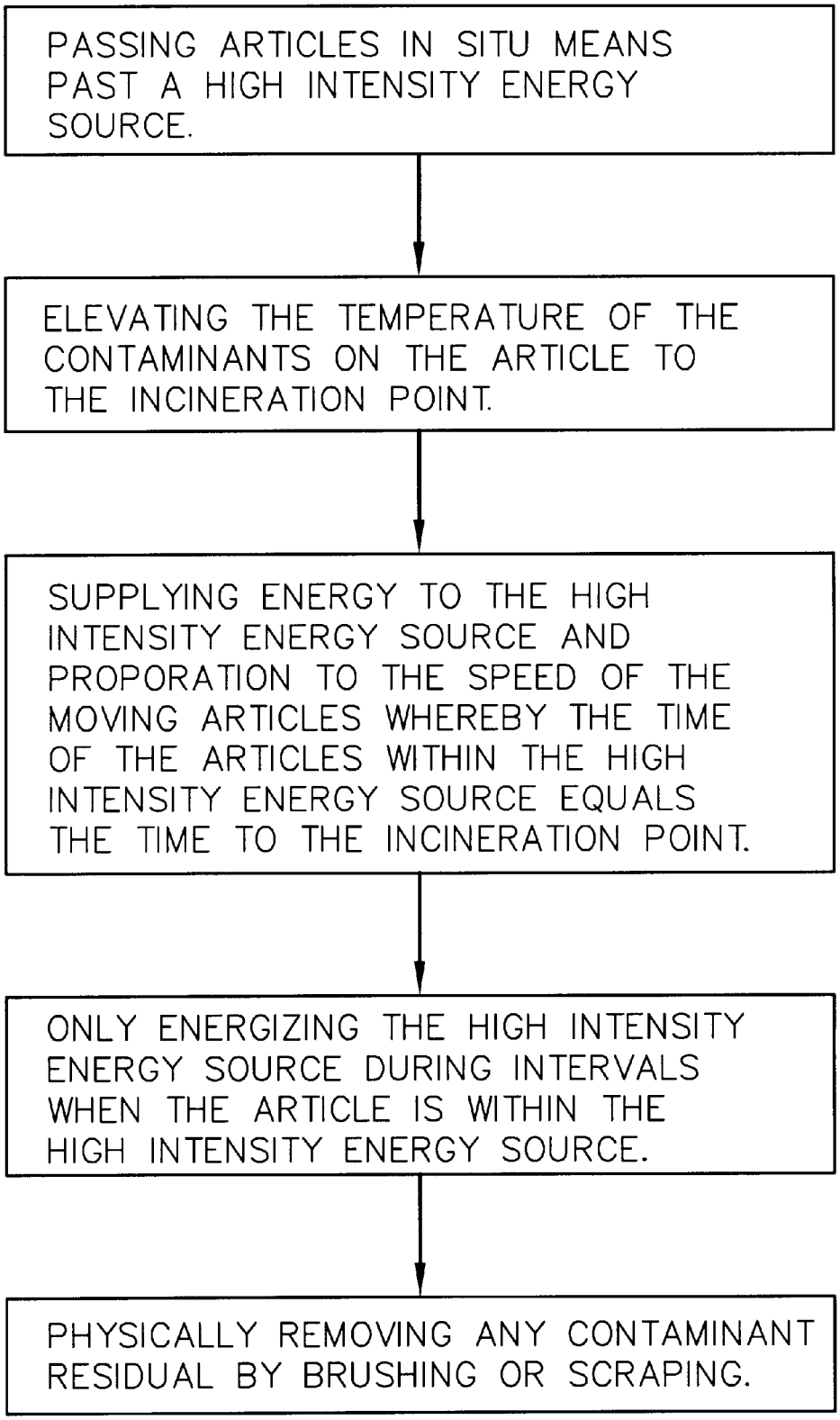
FIG. 2 is a flow chart describing a method of removing contaminant according to the present invention.

Referring to the drawing of FIG. 1, a typical in-line system for treating articles incorporating an embodiment of the present invention is illustrated. A monorail 28 provides conveyor support structure for the conveyance means through the in-line system but the conveyance means could be other than the monorail illustrated such as a belt drive, chain drive, etc.

A monorail 28 supports hangers 13 which in turn support articles to be treated in the in-line system. Starting to the left, article 22 moves from left to right, thereby first entering a coating spraying station 23 where articles, both the hanger 13 and work piece 22, are sprayed to provide that the work piece 22 is completely coated with an appropriate coating. Oven spray is conveyed by exhaust 24 to a coating collection point or for appropriate disposal and work pieces 22 emerge from the coating station having been completely coated as uncured coating work pieces 27.

Those pieces 27 then move into the drying or curing station 25, depending on the coating which may be a wet paint or a dry powder coating such as a polymer. Any affluent from the station 25 is transferred by the exhaust 26 to a conventional gas burning incinerator, not illustrated.

Upon leaving the curing station 25 the work pieces 27 which entered therein now have a coating 14 thereon which is thereby finished by being dried or completely cured. At this point the work piece 27 being completed can be removed from the production line and the hanger 13 may now continue on into the in-line heating station 15 which has a heating unit 16 of a high intensity energy source for quickly bringing the coating on the hangers 13 to the coating incineration point. This incineration point will vary with varying coatings but is, in each case, that temperature required to incinerate the coating to ash. A hanger 13 now having been cleaned is ready for use at position 21.

Where necessary a physical cleaning station 20 may be provided to physically remove any ash or like type contaminant which may remain using such things as brushes or a fluid spray.

Alternatively if the finished work piece 14 is found to be unsatisfactory rather than being removed at the exit of the curing station 25 the finished work piece 14 itself may continue on with the hanger 13 to the in-line heating stations 15 to also be cleaned in the same manner as the hanger 13. Upon its exit from the in-line heating station 15 the cleaned work piece 22 can be removed from the line for recoating.

It is envisioned also that the in-line heating station could be located off-line from the monorail 28 which supports the production line. Still, in this case the in-line heating station 15 would remain a high intensity energy source with a continuous flow of operation.

It should be noted that the coating station 23, to assure complete coverage of the work pieces 22, will provide a spray sufficient to coat at least a portion of the hangers 13 so that coating occurs complete from the coating mark 12 on the hangers 13 to the bottom of the coated work piece 27. Clearly, this coating mark carries over into the curing station and results in the coating being cured on the hangers 13 as well. It can be appreciated that there are systems where the hangers carry part support structures wherein the work pieces are sophisticated and require the support of such structures e.g. auto parts. These part support structures also end up below the coating mark 12. Thus, the hangers 13, part support structures, and the work piece 22 all can at one time or another be articles which pass through the heating station 15 for the purposes of cleaning.

The in-line heating station 15 incorporates a control unit 19 for the high energy source including conventional equipment such as switch gear, temperature controllers, logistic controls and limiting and alarming devices necessary for system control and proper operation. An enclosure 30 includes an inlet seal 17 as well as an exit seal, not illustrated, together with an exhaust system 32 having an affluent exhaust 18 creating an inner face between the exhaust system and a gas burning incinerator, not illustrated.

In a preferred embodiment of the present invention, coated hangers 13 are passed through the in-line heating station 15 each time that they are coated by the in-line system together with the production line work pieces 22. The hangers 13 are uninterrupted moving on a continuous basis past the high intensity energy source of a heating unit 16 operating in a range of 100 to 500 watts per square inch and preferably at 200 watts per square inch using short wave length energy of 1.0 to 5.0 microns and preferably 1.0 to 3.0 microns to elevate the coating contaminant on the hangers 13 to a temperature range of 800 to 2000° F. preferably 1000° F. within a time range of thirty to ninety seconds preferably one minute.

To obtain the above short heating times and high temperatures the heating station 30 and the high intensity energy source heating unit 16 was provided with high watt density electric infrared heaters. Other high intensity energy sources such as induction heating, electron beam, microwaves or open flame impingment, to name a few, could be used but they each present their own limitations. For example, induction heating requires a metallic article, while microwaves cannot tolerate metallic parts. The preferred infrared heaters do not have this limitation. Even more preferably, the heating unit 16 is provided with high temperature emitters incorporating high temperature reflective refractories, tungsten elements operating at temperatures ranging to 5000° F. and critical air cooling provisions. The use of short wave length energy allows penetration of the coating to thereby heat the article to incineration point temperatures as well as the coating contaminant. In this embodiment the coating was a wet application of paint.

It is also anticipated by the present invention that where the hangers 13 are narrow, and spaced far apart, the high intensity energy source would need to be arranged vertically to the direction of flow of the articles passing through it to provide a narrow heating zone which can be energized only when the article is within the field of heating the high intensity energy source. This enhances the efficiency of the heating station 15. Such efficiency is possible and particularly enhanced by the ability of the preferred infrared heating unit's rapid heating rate which can be taken from zero to full energy within one to two seconds.

In another preferred embodiment of the present invention, using the same heating unit 16 identified in the above embodiment, a tubular work piece coated with cured powder paint and of a rectangular cross section with a wall thickness of about 3/16" and 1/8" was passed by the heating unit 16 in 25 to 30 seconds to incinerate the paint on the 1/8" thick portion, while to obtain the same results for the 3/16" section required 50 to 60 seconds. Water was then sprayed on the tubular work piece which was still at or near incineration point temperature of the coating. Upon inspection the following day only a light powder residue, which wiped off with a finger touch, remained.

Lastly, in a third embodiment of the present invention the work piece 22 to be treated was an angle iron of rectangular cross section varying in thickness from 1/8" to 1/4"; the thicker portion being in the corner of the angle which required 40 seconds to bring the work piece in the thickest section to 1245° F. resulting in the coating thereon turning to ash.

From the above embodiments it can be appreciated that the material and physical make-up of the work piece, in addition to the coating of the work piece, such as the number of layers, significantly impact the method of the present invention, but in all instances the high intensity, short wave length energy source which penetrates the coating to be incinerated is the key to the short heating times permitting continuous and even in-line treating of work pieces to clean them or other articles of contaminants such as coatings.

It is anticipated that there is no limit to the variety of coatings which could be treated. Teflon coatings for example are anticipated to require temperatures as high as 1500° F. while the system is capable of temperatures ranging 2000° F. to 2500° F. on the hanger or work piece.

The invention has been described with reference to preferred embodiment. Obviously, modifications and alterations will occur to others upon a reading and understanding of this specification. It is intended to include all such modifications and alternations in so far as they come within the scope of the appended claims or the equivalence thereof.

Having thus described the invention, it is now claimed:

1. A method of rapid incineration of contaminants on articles in a continuous moving environment without removing the articles from the conveyance means, comprising the steps of:

A) passing the articles in situ on the conveyance means past a high intensity energy source;

B) elevating the temperature of the contaminants on the article to the incineration point;

C) supplying energy to the high intensity energy source in proportion to the speed of the moving articles whereby the time of the articles within the high intensity energy source equals the time to the incineration point and, D) only energizing the high intensity energy source during intervals when the article is within the high intensity energy source.

2. The method of claim 1 wherein the energy source is in a range of 100 to 500 watts/square inch.

3. Method of claim 1 wherein the temperature of the contaminant is elevated to the range of 800° F. to 2000° F.

4. Method of claim 1 wherein the article is within the energy source only 1¾ minutes.

5. The additional step to claim 1 of heating the article to a temperature equal to that of the method of claim 3.

6. The method of claim 1 including the further step of physically removing any contaminant residual.

7. The method of claim 6 wherein the physical removal step includes brushing.

8. The method of claim 6 wherein the physical removal step includes spraying a fluid.

9. The method of claim 9 including the further step of cleaning the article with an ultra-sonic cleaning bath.

* * * * *